US007526890B1

(12) United States Patent
Keng et al.

(10) Patent No.: US 7,526,890 B1
(45) Date of Patent: May 5, 2009

(54) ADJUSTABLE REAR PISTOL SIGHT AND SIGHT MOUNTING AND ADJUSTMENT METHOD

(76) Inventors: Da Keng, 1553 Shamrock Trail, SE., Smyrna, GA (US) 30080-5853; Maciej W. Matuszczak, 505 Bluff Ct., Woodstock, GA (US) 30188-5367

( * ) Notice: Subject to any disclaimer, the term of this patent is extended or adjusted under 35 U.S.C. 154(b) by 442 days.

(21) Appl. No.: 10/922,918

(22) Filed: Aug. 23, 2004

Related U.S. Application Data

(60) Provisional application No. 60/496,990, filed on Aug. 22, 2003.

(51) Int. Cl.
*F41G 1/00* (2006.01)

(52) U.S. Cl. ..... 42/136; 42/111; 42/138; 42/144

(58) Field of Classification Search ..... 42/111, 42/136, 138, 144
See application file for complete search history.

(56) References Cited

U.S. PATENT DOCUMENTS 455,911 A * 7/1891 Lyman ..... 42/138
1,206,060 A * 11/1916 Warner ..... 42/136
1,896,926 A * 2/1933 Von Frommer ..... 42/138
4,200,989 A * 5/1980 Brouthers ..... 42/137
4,628,611 A * 12/1986 Ruffino ..... 42/137
4,691,442 A * 9/1987 Center ..... 42/140
5,467,552 A * 11/1995 Cupp et al. ..... 42/125
6,622,415 B1 * 9/2003 Canaday et al. ..... 42/140
6,779,290 B1 * 8/2004 Houtsma ..... 42/148
7,181,882 B2 * 2/2007 Woodbury ..... 42/137
7,296,376 B2 * 11/2007 Kidd ..... 42/136
7,356,962 B2 * 4/2008 Swan ..... 42/147
2007/0199227 A1 * 8/2007 Ertl ..... 42/137

* cited by examiner

*Primary Examiner*—Michelle Clement
(74) *Attorney, Agent, or Firm*—Jones, Tullar & Cooper, PC

(57) ABSTRACT

A rugged, adjustable optical alignment device well suited for use as a pistol rear sight is adapted for use in a dovetail, as is customarily seen on the slide of an automatic pistol. The sight assembly includes a rear notch, but could just as easily include a peep aperture or other optical alignment structure. The rear sight provides an easy click-detent adjusting mechanism for horizontal translation of the notch, as well as a second click-detent mechanism for vertical translation of the structure defining the notch, thereby providing adjustments for windage and elevation. A base hingedly supports a vertical tilt member. A horizontal slide member mounted on the rear of the vertrical tilt member is horizontally translatable by adjustment of a windage adjustment screw.

16 Claims, 21 Drawing Sheets

216

ADJUSTABLE REAR PISTOL SIGHT AND SIGHT MOUNTING AND ADJUSTMENT METHOD

CROSS-REFERENCE TO RELATED APPLICATIONS AND CLAIM TO PRIORITY

This application claims the benefit (under 35 U.S.C. §§ 119(e) and 120) of U.S. provisional patent application No. 60/496,990, filed Aug. 22, 2003, the entire disclosure of which is incorporated herein by reference.

BACKGROUND OF THE INVENTION

1. Field of the Invention

The present invention relates to an adjustable optical device such as a pistol sight and a method for mounting and adjusting optical alignment devices such as gun sights on pistols or other firearms.

2. Discussion of the Prior Art

At present, a wide variety of optical sights are available for use on firearms such as pistols.

A typical handgun or pistol has optical alignment fixtures or sights including a front sight and a rear sight which are aligned with one another to form a sight picture for aligning the pistol's point of aim on a target. Prior art pistol sights are usually mounted along the top edge of the pistol. Traditional semi-automatic pistols (such as the well known Colt™ model 1911, caliber 0.45) include a grip or handle carrying a lower receiver and a trigger mechanism, with a slide member slidably supported on the lower receiver and surrounding the barrel.

The traditional front sight is a vertically projecting blade, post or ramp-like member mounted at the front of the slide and the rear sight is adapted for mounting to the rear of the slide using a dovetail shaped transverse protrusion that mates with a corresponding transverse dovetail shaped slot in the pistol's slide.

Police officers and members of the military require especially rugged sights on their weapons and so a genre of firearms and accessories adapted for "combat carry" has evolved to serve their special needs.

The applicant developed a fixed sight intended to provide a smooth and snag-free draw, a clear sight picture and rugged service; the applicant's fixed sight design is shown in Design Patent D447,205. Others, including gunsmith Wayne Novak, have also developed a number of designs for sights intended to provide rugged service, and such sights are often fitted in a transverse dovetailed notch having standardized dimensions known in the industry as the "Novak notch" dimensions. By "transverse" is meant in a direction at a right angle to the pistol bore and lying in a horizontal plane when the pistol is held in a standard vertically aligned grip with the bore centerline in a horizontal plane. Generally, the standard notch will slidably receive and support a dovetail-like projection that is 12.5 millimeters (mm) in fore-aft length along a planar bottom surface and tapers inwardly at a selected angle (e.g., 60 to 70 degrees) from horizontal on front and back wall surfaces; the bottom planar surface of the sight's dovetail shaped projection is preferably 3 mm in vertical height from the upper surface of the notch opening, within customary gunsmithing tolerances.

While the combat sights of the prior art do provide a smooth and snag-free draw, a clear sight picture and rugged service, they do not provide the adjustability many have come to enjoy when using target pistols equipped with adjustable target sights.

Pistol sights are often used in a variety of situations. A sight is customarily optically aligned along the axis of the bore and used to align the bore of the firearm with the target. Target sights are usually adjustable in the left and right direction for "windage" and in the up and down direction for "elevation." Usually, a shooter will mount a sight to a firearm and then immediately "zero" the sight by a procedure of adjusting windage and elevation settings so that the sight's point of aim corresponds with the projectile's point of impact for a selected target at a desired range.

Traditional combat carry sights, as described above, are usually not adjustable for windage, and so shooters have turned to permanently altering the front sight post by filing it down (to raise the point of impact) or substituting a taller front sight blade (to lower the point of impact). Adjustments for windage have required the shooter to strike the side of the sight with a pin punch and hammer, to force the sight laterally in the notch, a procedure which does not permit fine adjustment.

If a target sight is mounted to a large caliber firearm generating large recoil forces, the zero may change after firing several rounds and the sight must then be adjusted for proper zero again. Target sights are also relatively fragile, and may move out of adjustment if a pistol is dropped or struck. Both of these results present an unsatisfactory result if the firearm is to be used in life-threatening situations.

There has been a long felt need, then, for a method and apparatus permitting attachment and adjustment of a combat carry style rear sight or the like on a firearm such as a pistol, permitting the shooter to quickly and easily zero the sights.

OBJECTS AND SUMMARY OF THE INVENTION

Accordingly, it is a primary object of the present invention to overcome the above mentioned difficulties by providing a method and apparatus permitting the user to rigidly affix a sight onto a firearm and to permit precise and convenient sight adjustment.

Another object of the present invention is attaching an adjustable optical alignment device to a mount to permit a smooth and snag-free draw, a clear sight picture and rugged service.

The aforesaid objects are achieved individually and in combination, and it is not intended that the present invention be construed as requiring two or more of the objects to be combined unless expressly required by the claims attached hereto.

In accordance with the present invention, an optical aligning instrument, or sight, is adapted for use in a Novak-style dovetail, as is customarily seen on the slide of an automatic pistol. The sight assembly includes a rear notch, in the embodiments illustrated below, but could just as easily include a peep aperture or other optical alignment structure. The rear sight provides an easy click-detent adjusting mechanism for horizontal translation of the notch, as well as a second click-detent mechanism for vertical translation of the structure defining the notch, thereby providing for the customary adjustments of windage and elevation, without requiring the shooter to either file down the front sight or strike his or her pistol with a hammer and drift pin.

In the adjustable rear pistol sight of the present invention, the adjustable sight assembly includes a base with a downwardly-projecting dovetail-shaped member adapted to fit in the pistol's transverse dovetail slot, and the base carries a vertical tilt member hinged to rotate about an axis defined by a elevation-tilt hinge pin carried by laterally spaced bosses or vertical walls projecting up from the base. The vertical translation of the sighting notch (or other optical alignment structure) is accomplished by adjusting an elevation adjustment screw removably received in a threaded bore defined in the vertical tilt member and threadably received in the base. The elevation adjustment screw has a flanged head adapted to engage or cooperate with a detent mechanism to provide positive click adjustment to give the user feedback, and to maintain the zero setting during rugged use of the firearm. The vertical tilt member is biased upwardly, away from the base by a coil spring or other elastic force-supplying structure (referred to broadly as a "spring").

In the adjustable sight assembly of the exemplary embodiment, the vertical tilt member carries a horizontal slide which preferably includes or defines a sighting notch that is translatable in the horizontal, or windage, direction by use of a click-detent windage adjustment screw. The windage adjustment screw also has a flanged head adapted to engage or cooperate with a detent mechanism provide positive click adjustment and give the user feedback, and to maintain the zero setting during rugged use of the firearm. The horizontal slide member has a cantilevered, or forwardly-projecting, cylindrical member carried by a connecting support segment affixed to a vertical front wall surface, and the interior of the cylindrical segment is threaded to received and cooperate with the threaded windage adjustment screw. The windage adjustment screw moves the cylindrical segment of the horizontal slide member left and right laterally through an adjustment range provided by a rearward-facing slot defined in the vertical tilt member. The windage adjustment screw is kept in place by a threaded member or nut which is received in a circular receiving socket or aperture on the side of the vertical tilt member; the depth of the socket is substantially equal to the thickness of the nut so that the nut is sunken within the side wall to provide a flush fit. The windage adjustment screw has first and second outer diameters, with the distal end of the windage adjustment screw having a smaller diameter than the majority of the length of the elevation adjustment screw body. The smaller distal portion of the elevation adjustment screw is threadably received in the retaining nut which, being round, spins freely within the socket defined in the side of the vertical tilt member. Rotation of the windage adjustment screw causes the cylindrical member carried by the horizontal slide to move left and right freely within the vertical tilt member tunnel. A substantially rectangular slot provides clearance for the supporting steel segment which connects the horizontal slide member's cylindrical segment to the exposed rear portion of the horizontal slide, defining the sighting notch.

In use, the adjustable sight assembly is installed by inserting the dovetail-shaped base into the Novak-style transverse dovetail-shaped slot in a pistol slide or firearm receiver, and the gunsmith or shooter estimates an appropriate central location for the sight assembly. A base set screw is then tightened, preferably with an Allen wrench or hex key, to (at least preliminarily) fix the lateral position of the sight assembly in the slide notch. Once installed, the user may twist the elevation adjustment screw against its detent to adjust the vertical translation of the vertical tilt member, which swings through an arc about the hinge pin. The elevation adjustment of the sight is held steady by the elevation tilt bias spring, which may provide some shock-absorbent qualities in the event the pistol is dropped.

The user then turns the windage adjustment screw against its spring-biased detent to laterally translate the horizontal slide to adjust the lateral position of the sighting notch and the point of impact for a given point of aim.

The above and still further objects, features and advantages of the present invention will become apparent upon consideration of the following detailed description of a specific embodiment thereof, particularly when taken in conjunction with the accompanying drawings, wherein like reference numerals in the various figures are utilized to designate like components.

DESCRIPTION OF THE PREFERRED EMBODIMENT

Figure 1:
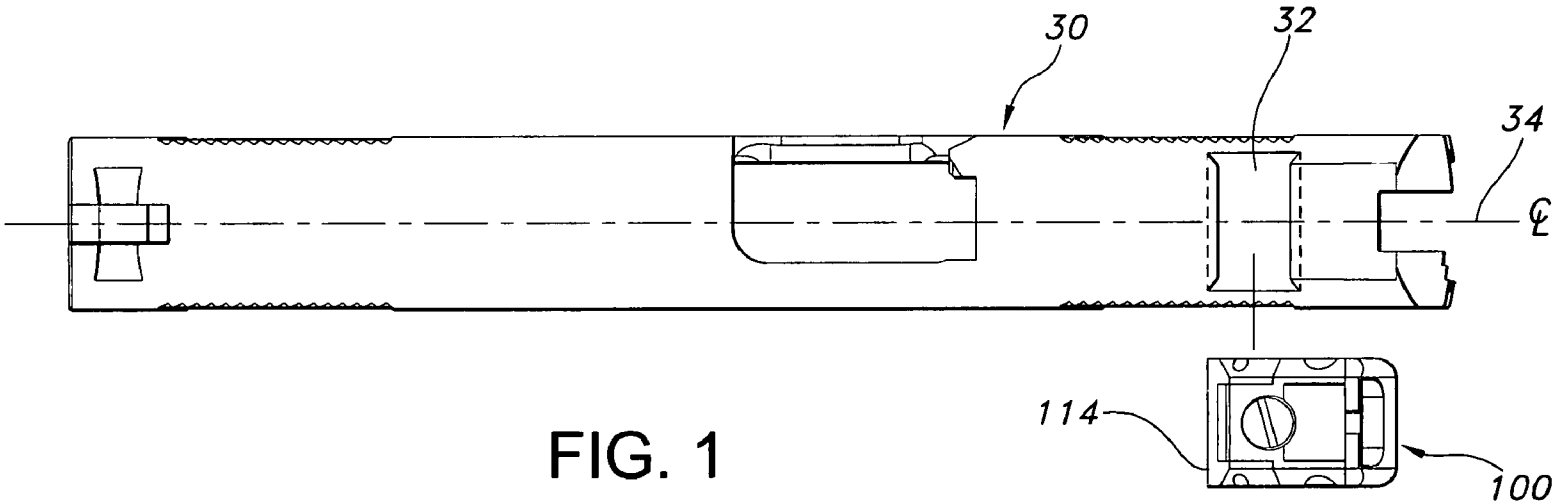
FIG. 1 is a top or overhead view, in elevation, of the adjustable sight assembly of the present invention aligned for insertion in the sight carrying notch of a pistol slide, in accordance with the method of the present invention.
Figure 2:
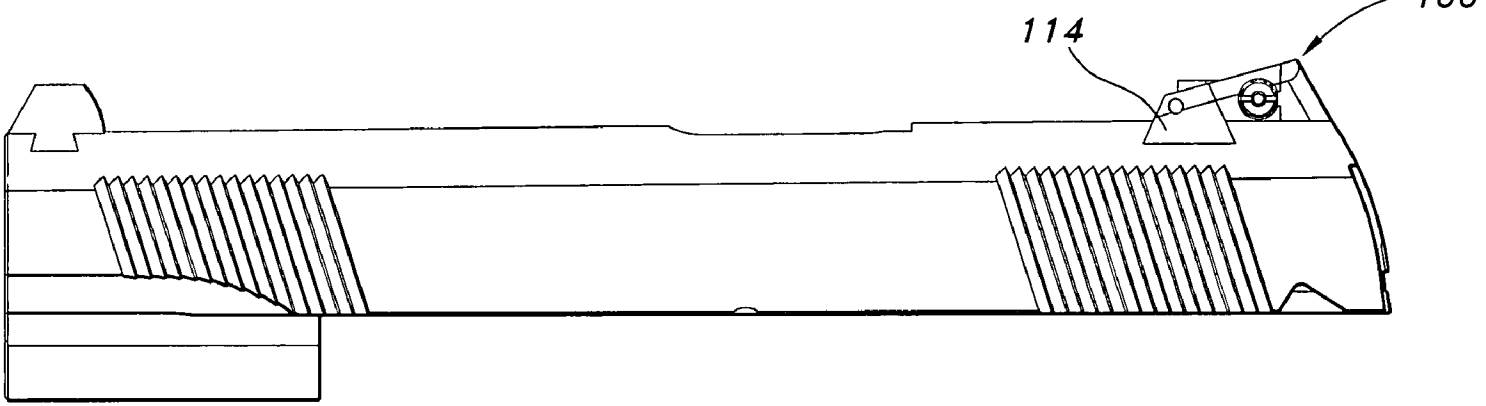
FIG. 2 is a left side view, in elevation, of the adjustable sight assembly of FIG. 1 inserted in the sight carrying notch of the pistol slide, in accordance with the method of the present invention.
Figure 3:
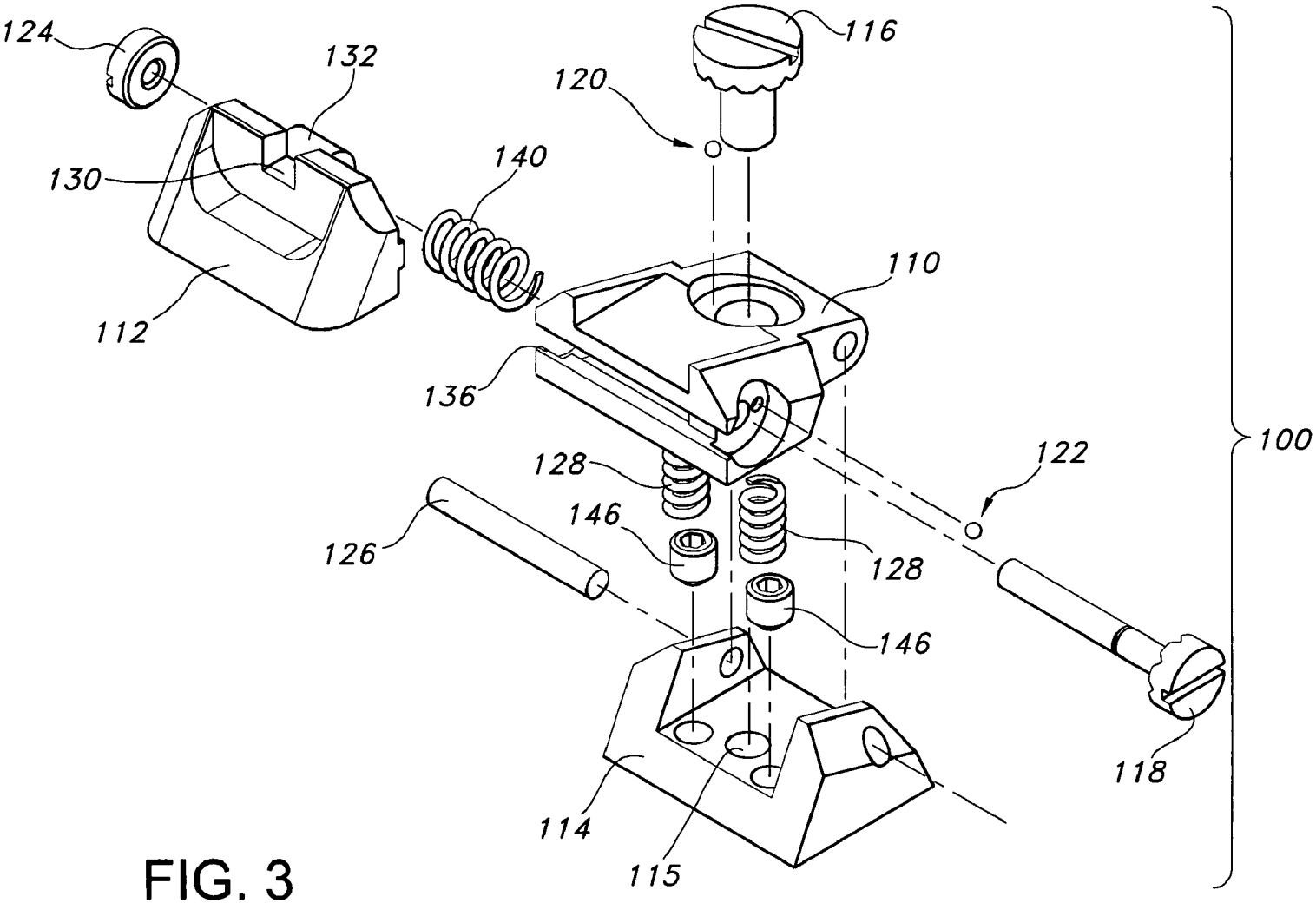
FIG. 3 is an exploded perspective view of the adjustable sight assembly of FIGS. 1 and 2, in accordance with the present invention.
Figure 4D:
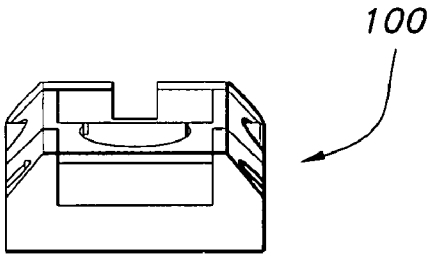
FIGS. 4*a* through 4*f* are six views of the adjustable sight assembly of FIGS. 1 and 3.
Figure 4F:
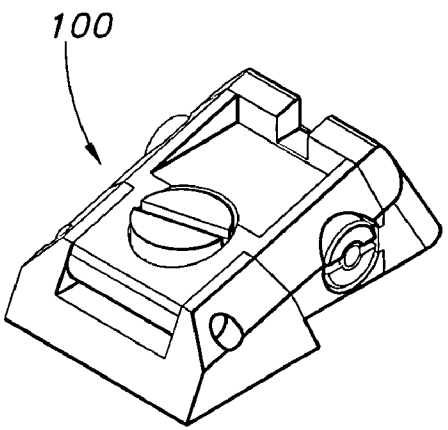
Figure 4C:
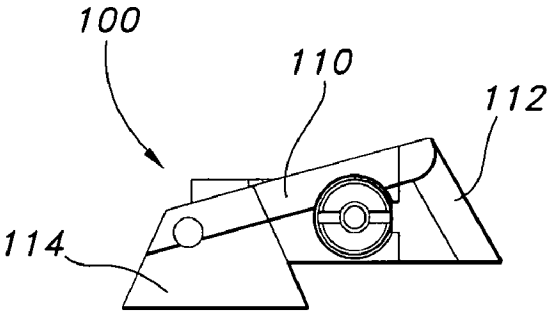
Figure 4E:
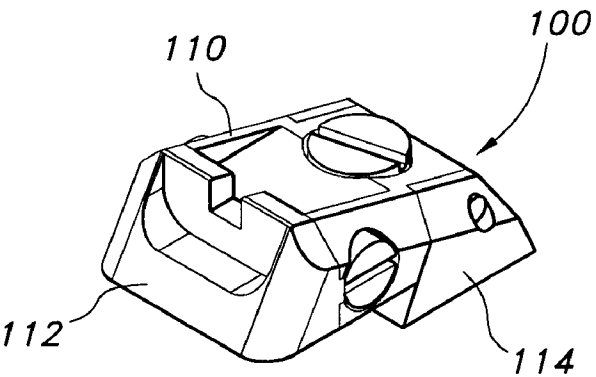
Figure 4B:
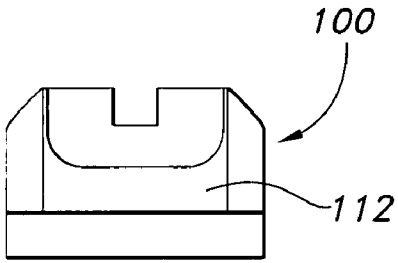
Figure 4A:
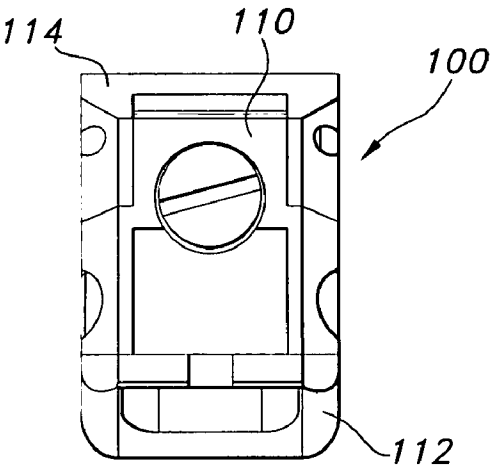
Figure 5C:
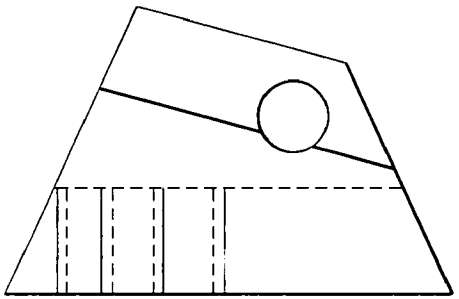
FIGS. 5*a* through 5*d* are detailed views of the base member of the adjustable slide assembly of FIG. 1, in accordance with the present invention.
Figure 5D:
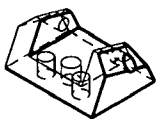
Figure 5B:
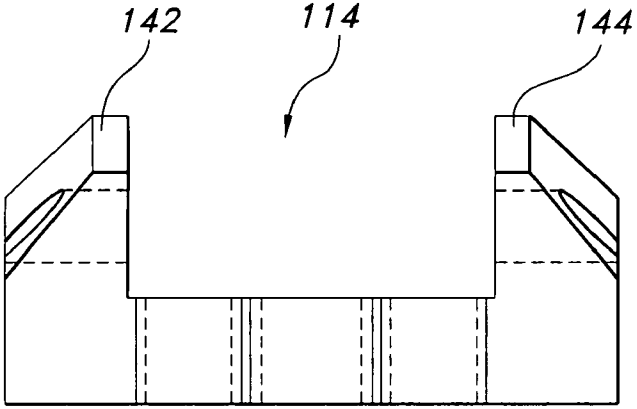
Figure 5A:
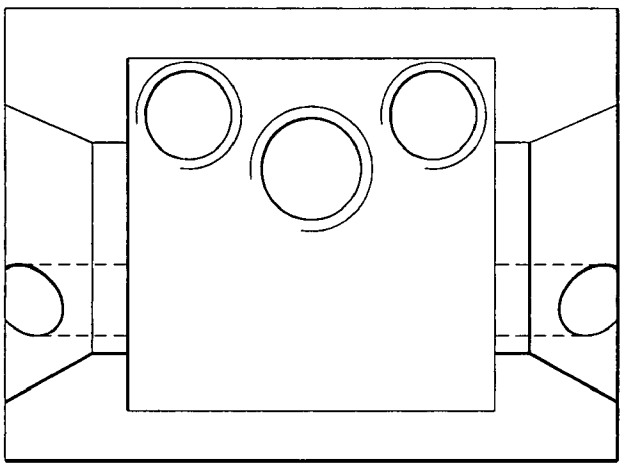
Figure 6C:
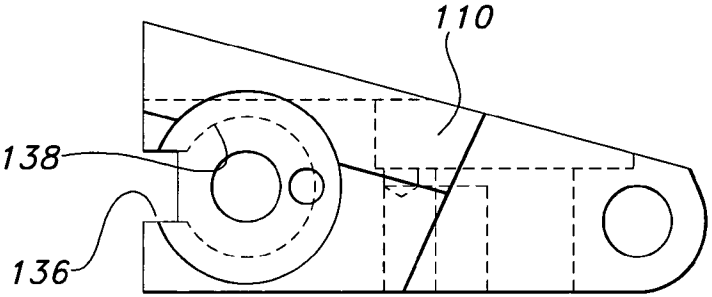
FIGS. 6*a* through 6*d* are detailed views of the vertical tilt member for the adjustable sight assembly of FIG. 1, in accordance with the present invention.
Figure 6D:
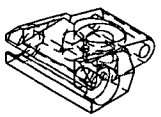
Figure 6B:
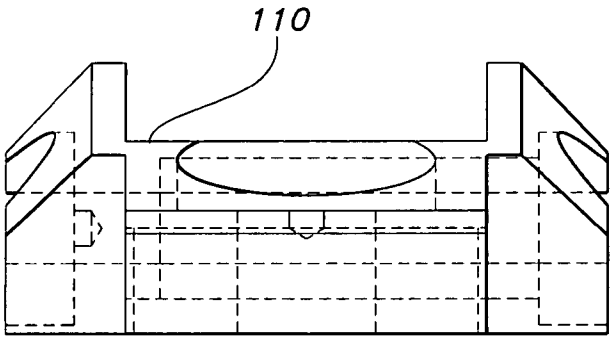
Figure 6A:
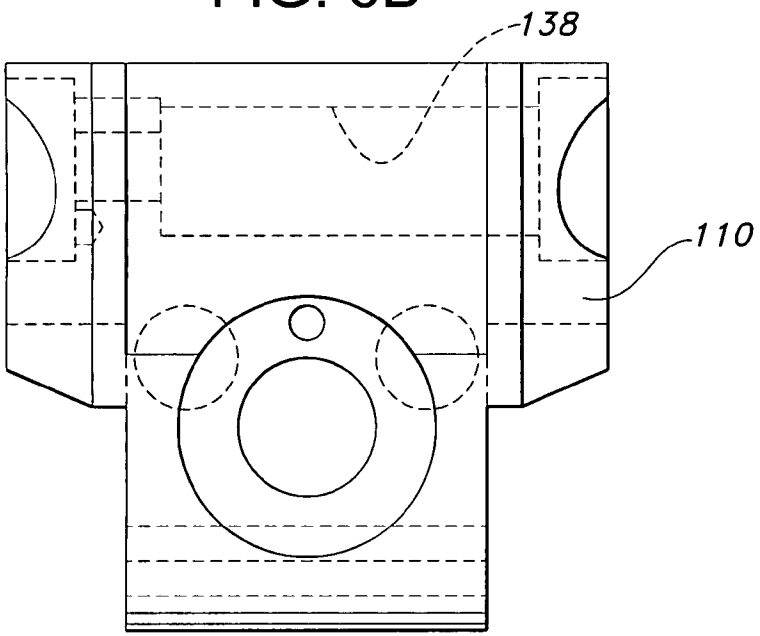
Figure 7C:
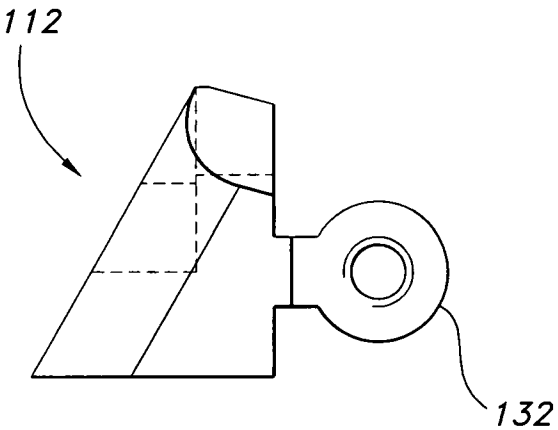
FIGS. 7*a*-7*d* are detailed views of the horizontal slide member the adjustable sight assembly of FIG. 1, in accordance with the present invention.
Figure 7D:
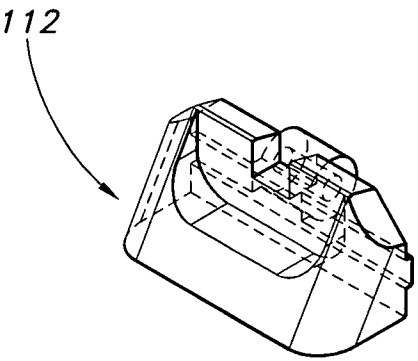
Figure 7B:
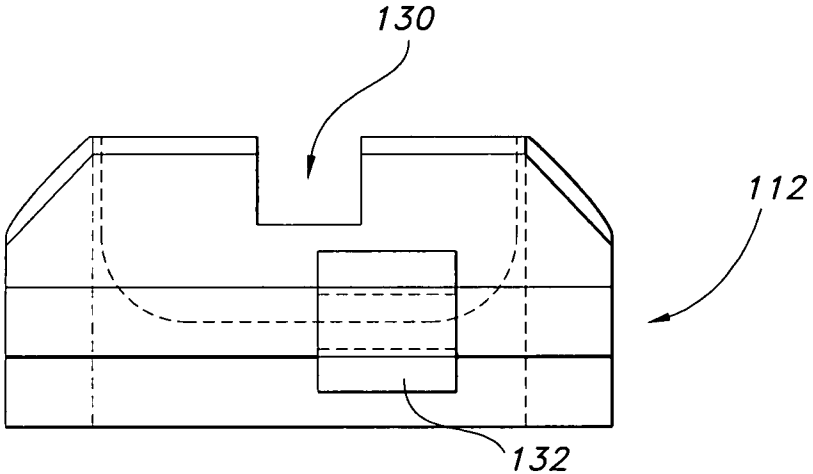
Figure 7A:
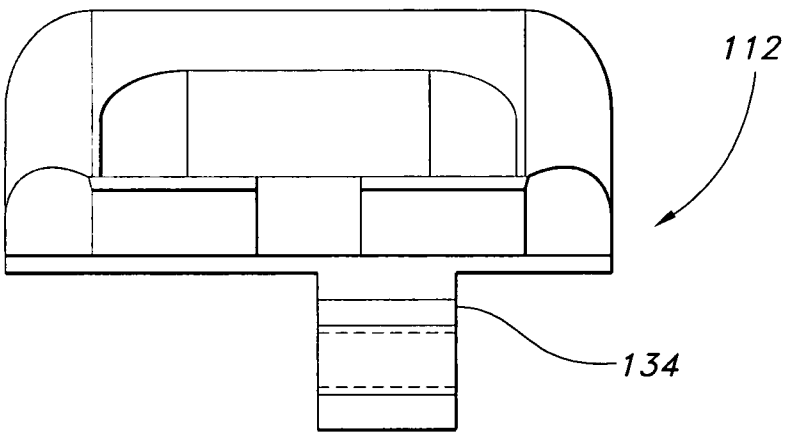
Figure 8C:
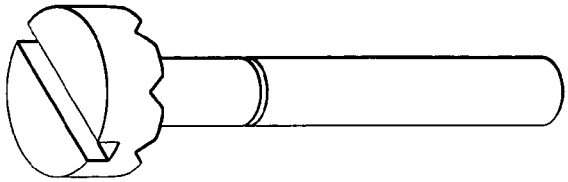
FIGS. 8*a* through 8*d* are detailed views of the windage adjustment screw of the adjustable sight assembly of FIG. 1, in accordance with the present invention.
Figure 8B:
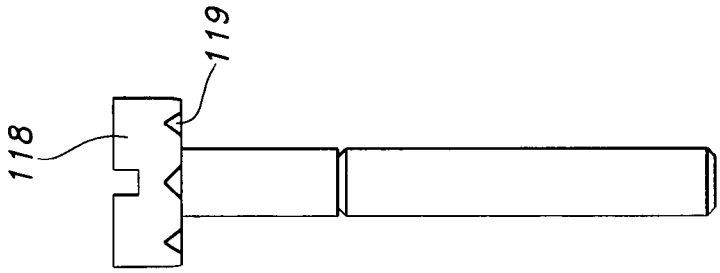
Figure 8A:
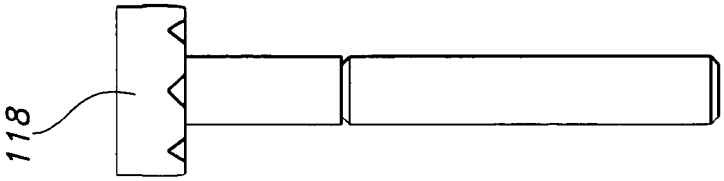
Figure 8D:
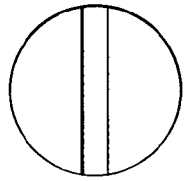
Figure 9C:
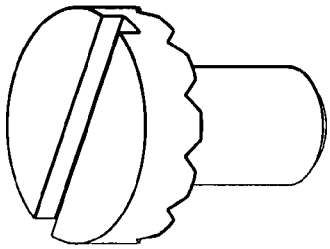
FIGS. 9*a* through 9*d* are detailed views of the elevation adjustment screw of the adjustable sight assembly of FIG. 1, in accordance with the present invention.
Figure 9B:
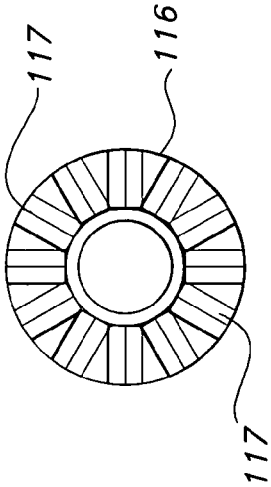
Figure 9A:
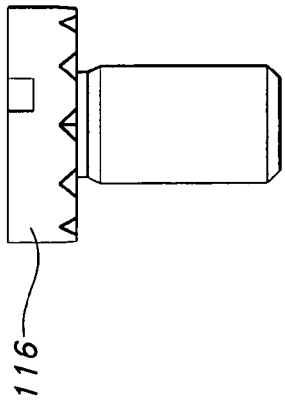
Figure 9D:
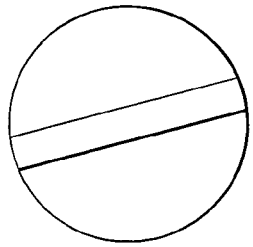
Figure 11A:
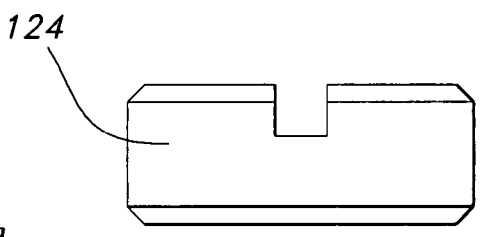
FIGS. 11*a* and 11*b* are detailed views of the windage adjustment nut of the adjustable sight assembly of FIG. 1, in accordance with the present invention.
Figure 11B:
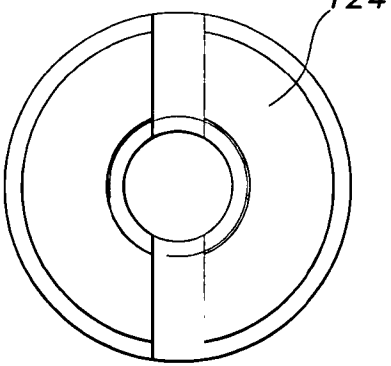
Figure 10C:
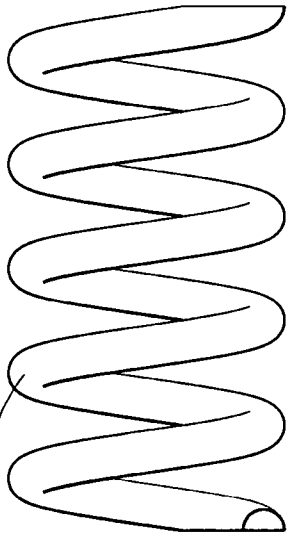
FIGS. 10*a* through 10*c* are detailed views of the hinge pin, an elevation tilt bias spring member and the windage adjustment spring member of the adjustable sight assembly of FIG. 1, in accordance with the present invention.
Figure 10B:
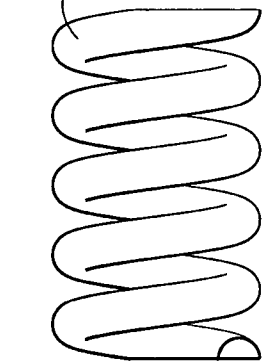
Figure 10A:
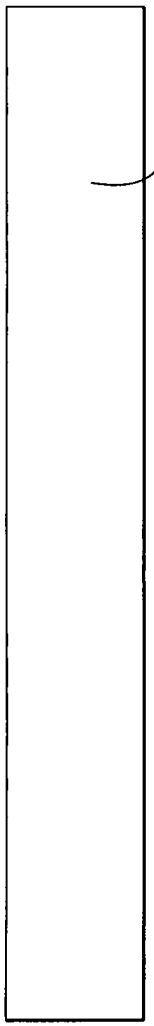
Figure 12:
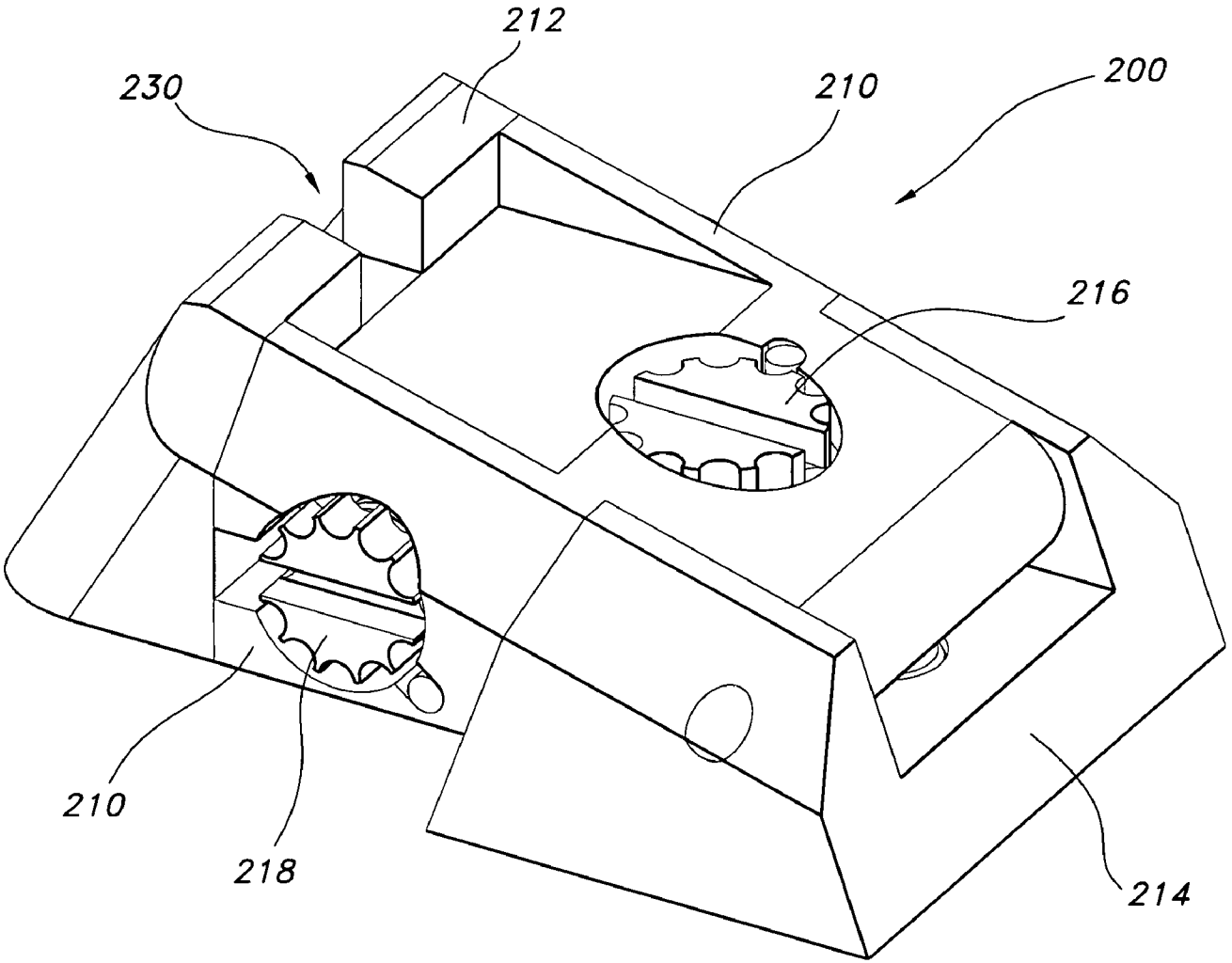
FIG. 12 is a perspective view, in elevation, of a second embodiment of the adjustable sight assembly of the present invention.
Figure 13:
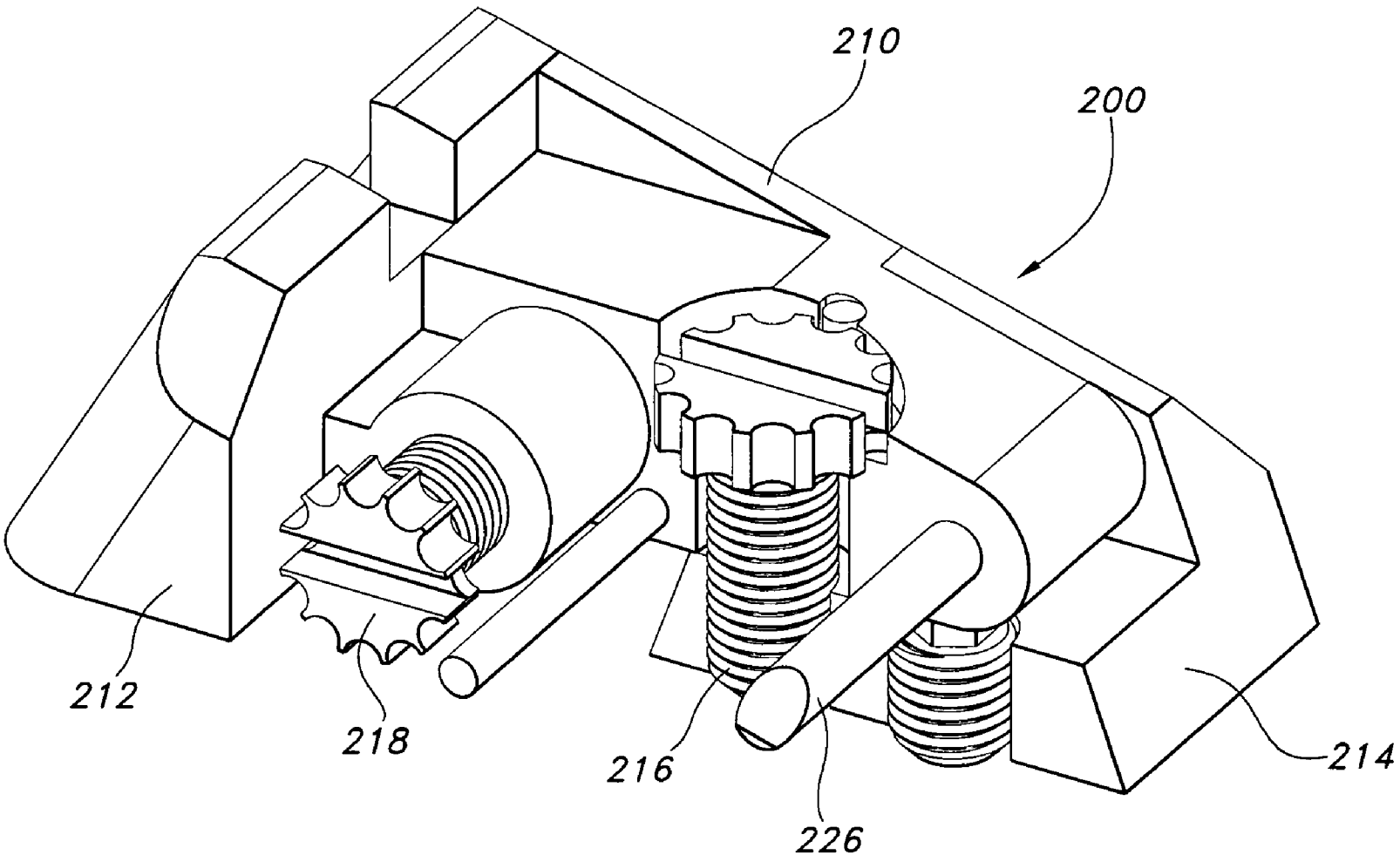
FIG. 13 is a perspective view, in partial cross-section, of the adjustable sight assembly of FIG. 12, in accordance with the present invention.
Figure 14:
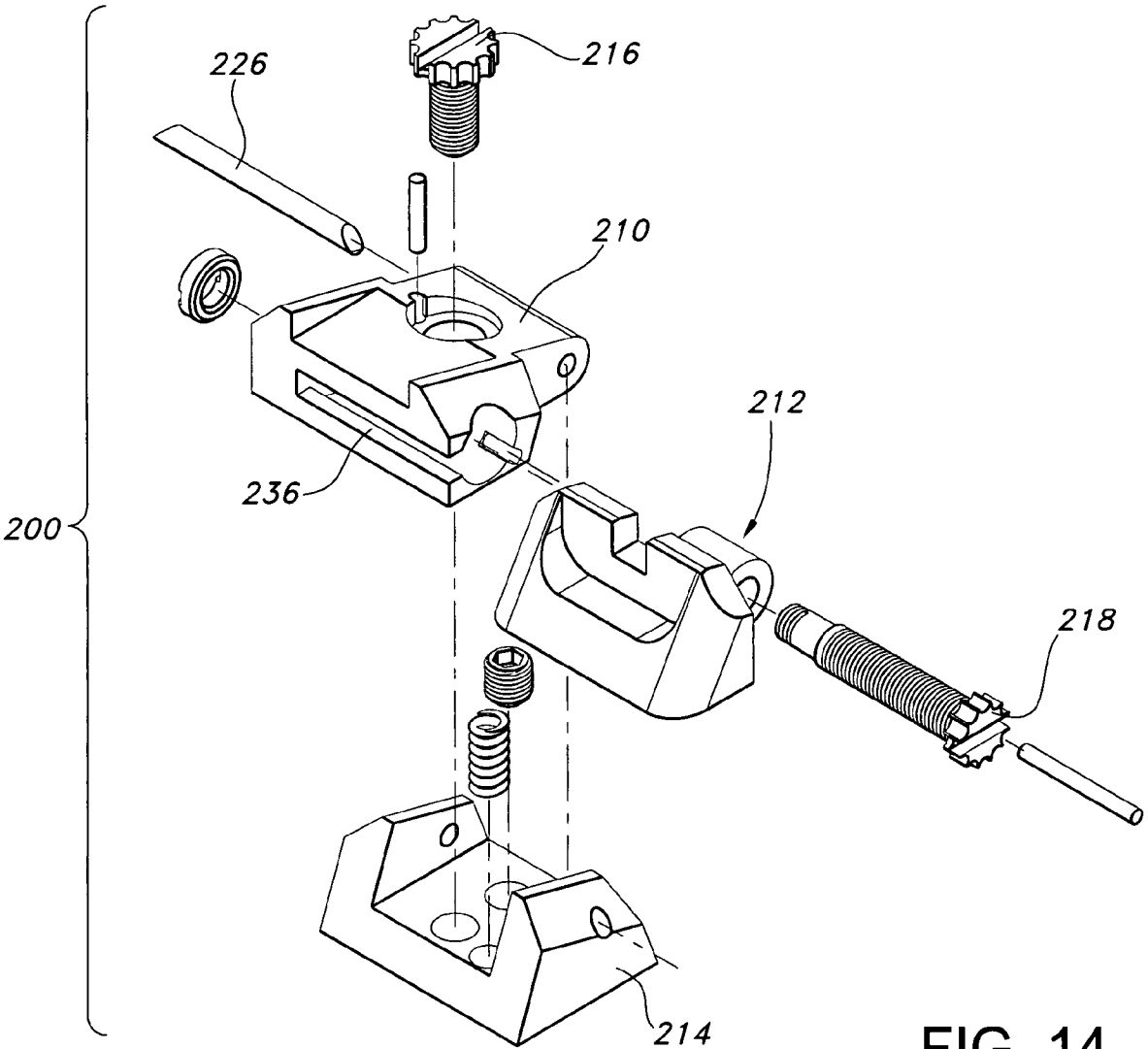
FIG. 14 is an exploded view, in perspective, of the adjustable sight assembly of FIG. 12.
Figure 15D:
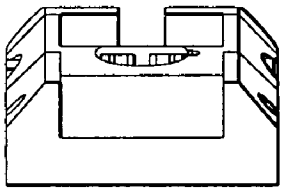
FIGS. 15*a* through 15*f* are detailed views of the adjustable sight assembly of FIG. 12.
Figure 15E:
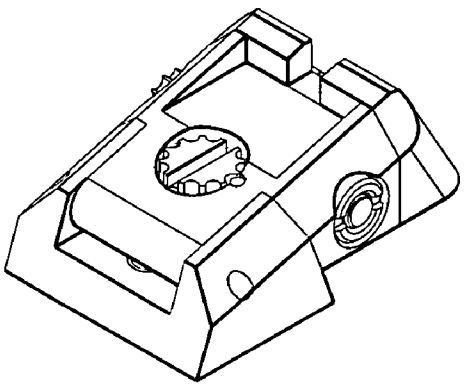
Figure 15C:
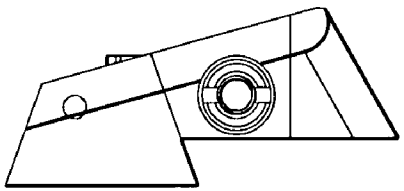
Figure 15F:
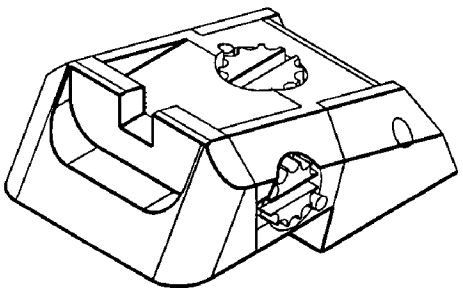
Figure 15B:
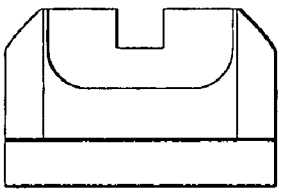
Figure 15A:
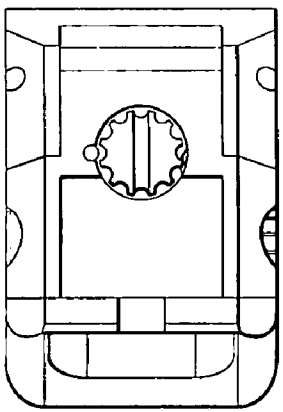
Figure 16:
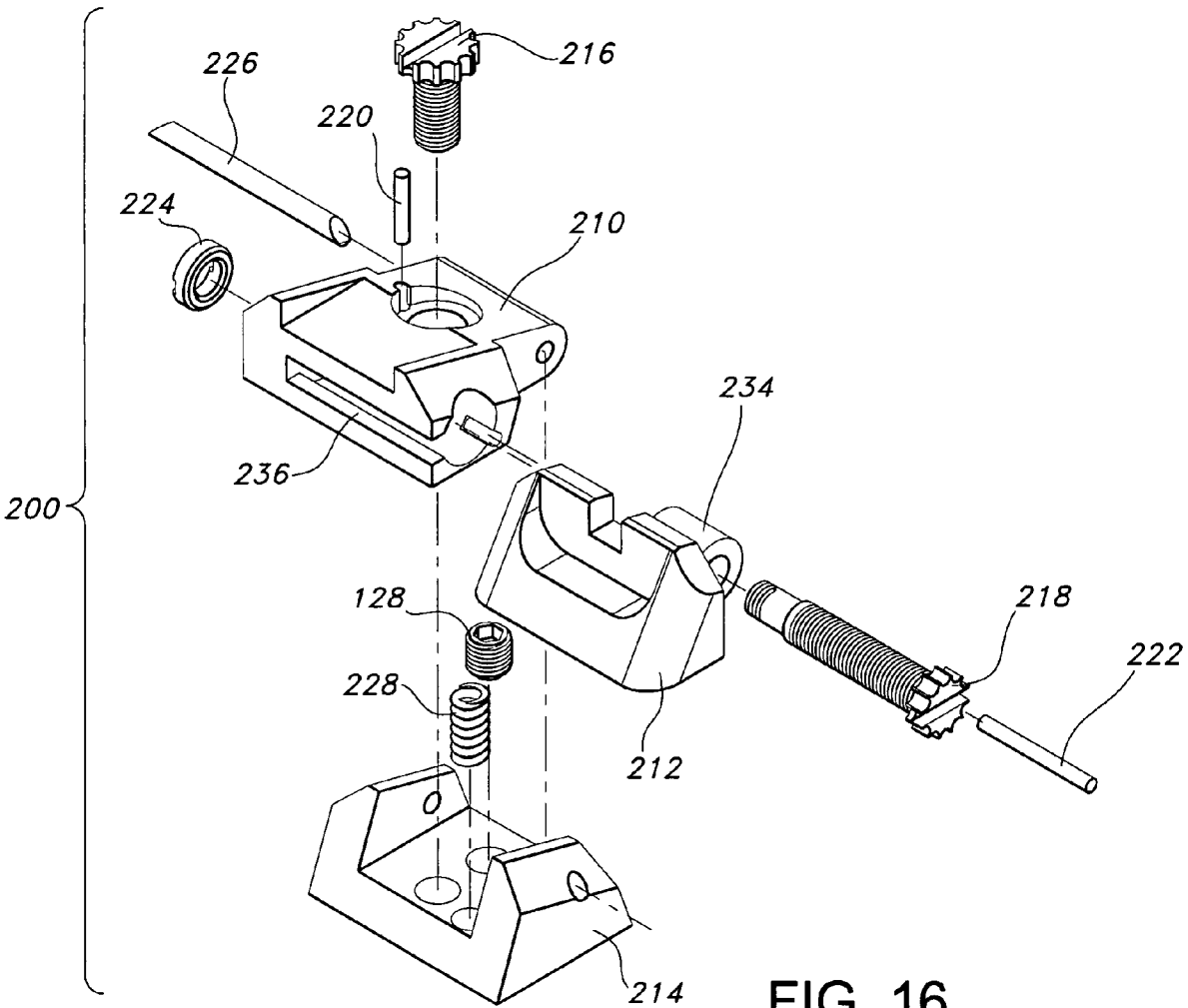
FIG. 16 is an exploded view, in perspective, of the adjustable sight assembly of FIG. 12.
Figure 17C:
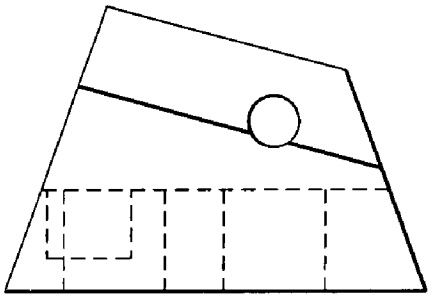
FIGS. 17*a* through 17*d* are detailed views of the base member for the adjustable sight assembly of FIG. 12.
Figure 17D:
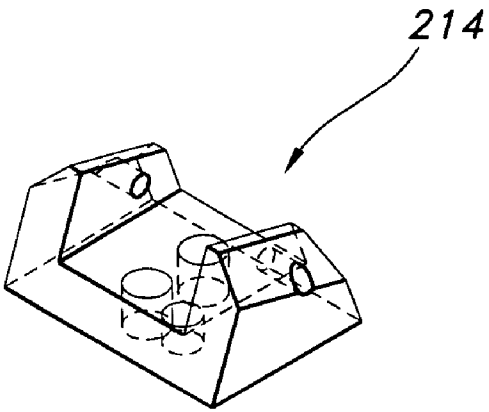
Figure 17B:
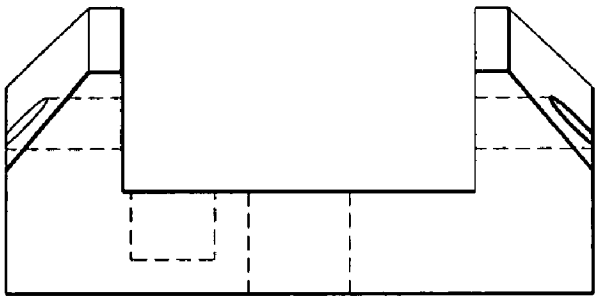
Figure 17A:
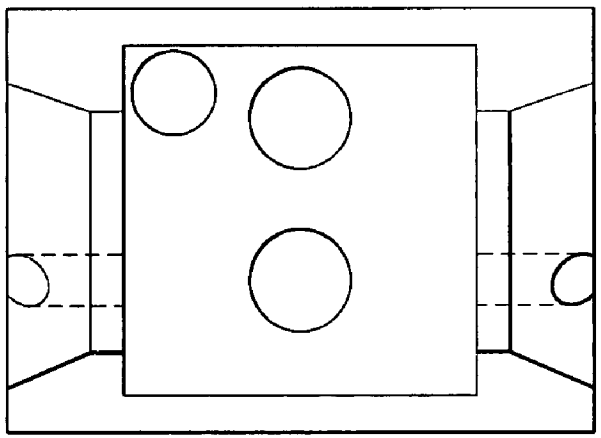
Figure 18C:
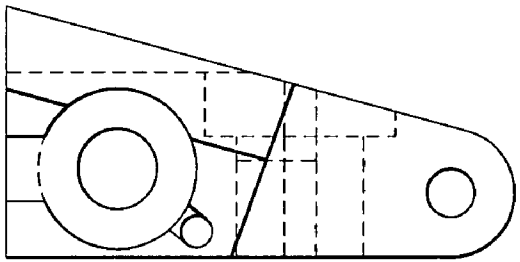
FIGS. 18*a* through 18*d* are detailed views of the vertical tilt member for the adjustable sight assembly of FIG. 12.
Figure 18D:
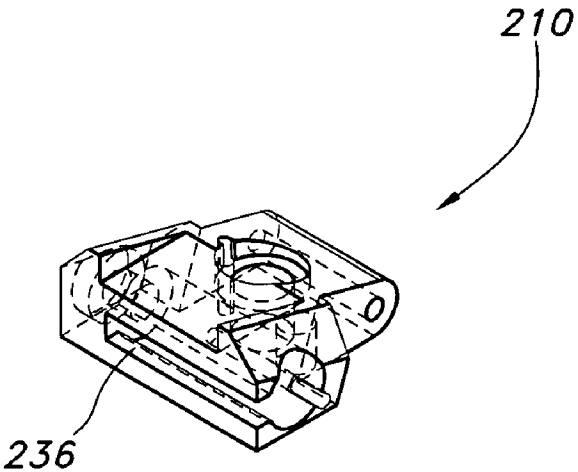
Figure 18B:
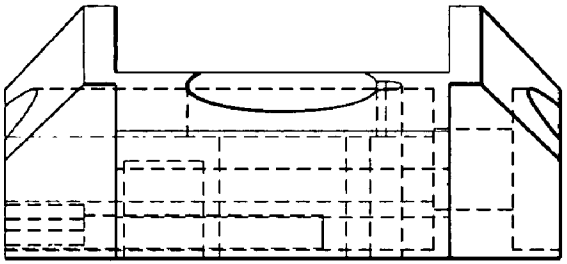
Figure 18A:
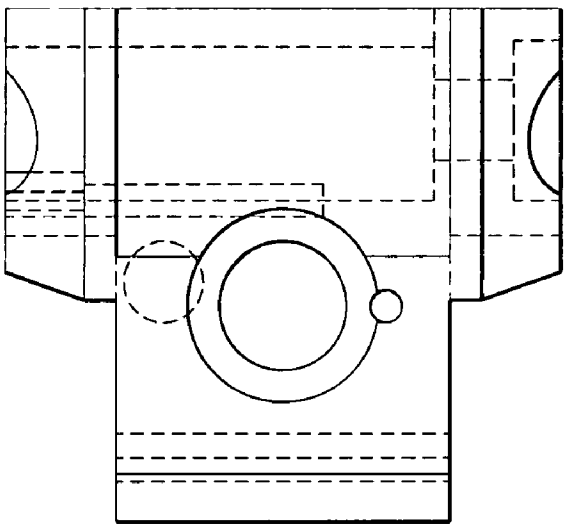
Figure 19C:
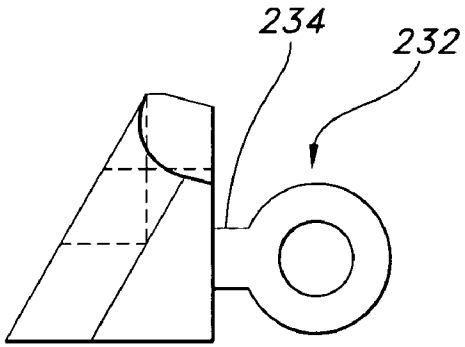
FIGS. 19*a* through 19*d* are detailed views of the horizontal slide member of the adjustable sight assembly of FIG. 12.
Figure 19D:
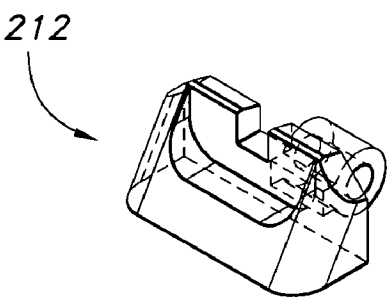
Figure 19B:
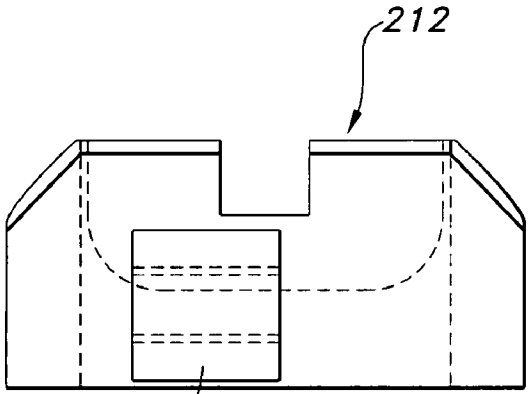
Figure 19A:
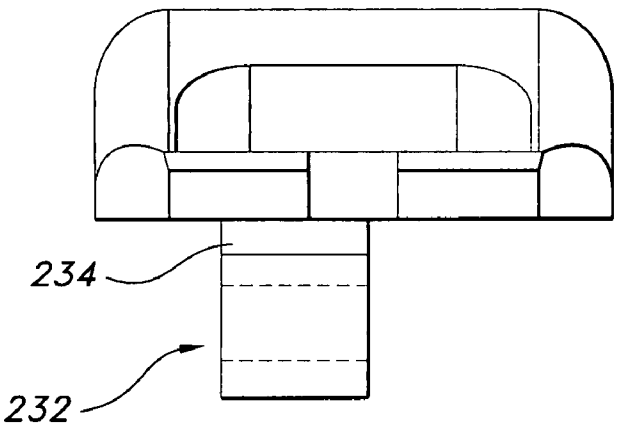
Figure 20D:
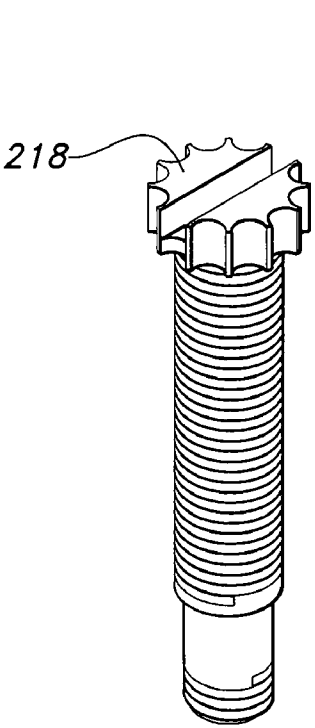
FIGS. 20*a* through 20*d* are detailed views of the windage adjustment screw of the adjustable sight assembly of FIG. 12.
Figure 20C:
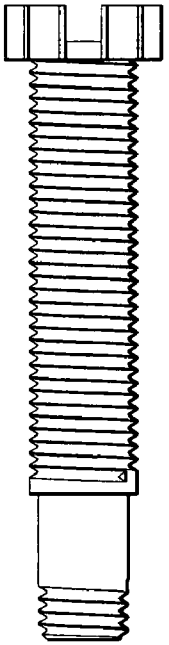
Figure 20B:
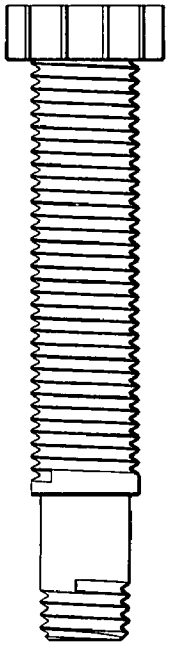
Figure 20A:
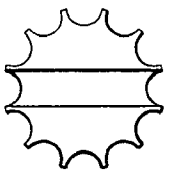
Figure 21D:
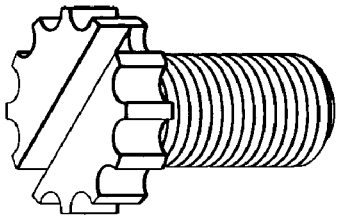
FIGS. 21*a* through 21*d* are detailed views of the elevation adjustment screw of the adjustable sight assembly of FIG. 12.
Figure 21C:
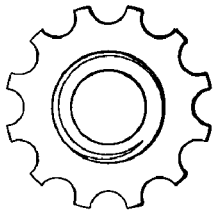
Figure 21B:
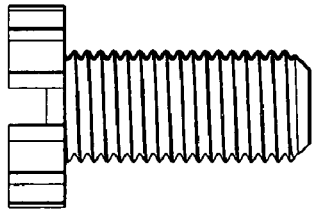
Figure 21A:
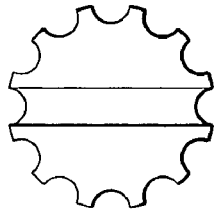
Figure 22C:
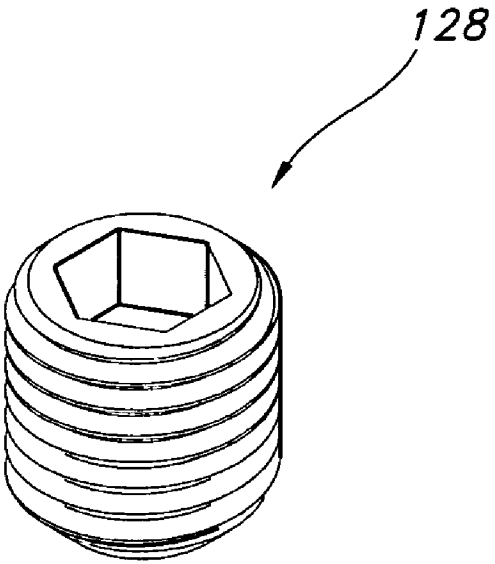
FIGS. 22*a* through 22*c* are detailed views of the base screw used for either of the adjustable sight assemblies shown in FIGS. 1 through 21.
Figure 22B:
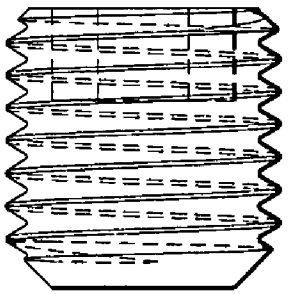
Figure 22A:
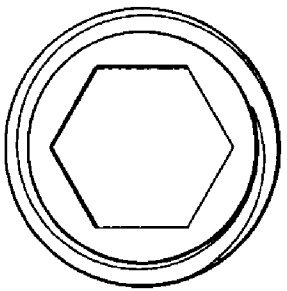
Figure 23E:
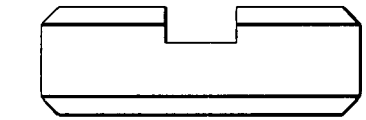
FIGS. 23*a* through 23*f* illustrate the elevation tilt hinge pin, the elevation tilt bias spring, the elevation detente pin, the windage detent pin and the windage nut fastener, respectively.
Figure 23F:
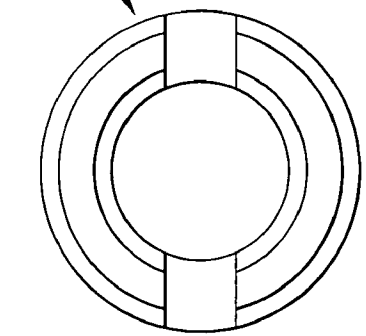
Figure 23D:
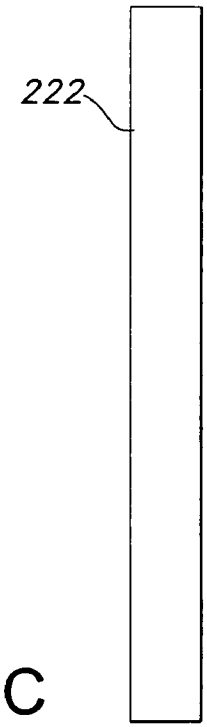
Figure 23C:
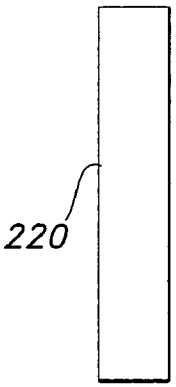
Figure 23B:
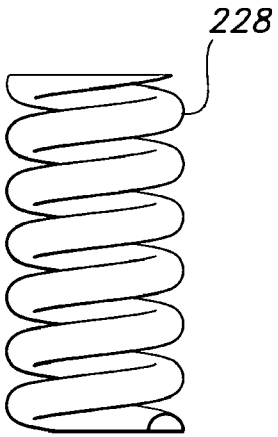
Figure 23A:
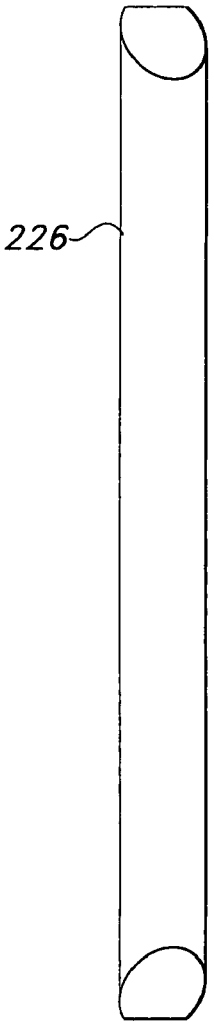

As best seen in FIGS. 1 and 2, a first embodiment of adjustable sight assembly 100 is aligned with Novak-style dovetail notch 32 to permit mounting sight assembly 100 on pistol slide 30. FIG. 2 illustrates a side view of adjustable sight assembly 100 in dovetail notch 32 on pistol slide 30 and shows the orientation of sight base 114 when received within notch 32.

Referring now to FIGS. 3-11*b*, in the first embodiment of the adjustable rear pistol sight of the present invention, adjustable sight assembly 100 preferably includes a base 114 with a downwardly-projecting dovetail-shaped member adapted to fit in the pistol's transverse dovetail slot, and base 114 carries a vertical tilt member 110 hinged to rotate about an axis defined by an elevation-tilt hinge pin 126 carried by laterally spaced vertically projecting side walls or bosses on base 114. The vertical translation of the sighting notch 130 (or any other optical alignment structure) is accomplished by adjusting an elevation adjustment screw 116 removably received in a threaded bore 115 in base 114 and aligned with a through bore in vertical tilt member 110. Elevation adjustment screw 116 has a flanged head with radially aligned scallops or grooves 117 (best seen in FIG. 9*b*) adapted to engage a ball detent 120 to provide positive click adjustment to give the user feedback, and to maintain the zero setting during rugged use of the firearm.

Vertical tilt member 110 is biased upwardly, away from base 114 by at least one (and preferably two symmetrically arranged) elevation tilt bias spring(s) 128 or other elastic force-supplying structure (referred to broadly as a "spring").

In the adjustable sight assembly 100, the vertical tilt member 110 carries a horizontal slide 112 which preferably includes a substantially planar, non-reflective rear facing surface with an opening that defines sighting notch 130. Horizontal slide member 112 is translatable in the horizontal, or windage, direction by use of a click-detent windage adjustment screw 218. Windage adjustment screw 118 has a flanged head with radially aligned scallops or grooves 119 (best seen in FIG. 8*b*) adapted to engage a ball detent 122 to provide positive click adjustment and give the user feedback, and to maintain the zero setting during rugged use of the firearm.

As best seen in FIGS. 3 and 7*a* through 7*c*, horizontal slide member 112 has a cantilevered, or forwardly-projecting, cylindrical sleeve 132 carried by a 5 mm wide 2 mm thick connecting sleeve support segment 134 affixed to a vertical front wall surface, and the interior of the cylindrical segment is threaded to receive and cooperate with the threaded windage adjustment screw 118. Horizontal slide cylindrical sleeve 132 preferably defines a through-bore with a radius of 2.5 mm threaded with M3×0.35 threads; the outer cylindrical wall preferably has a radius of 2.5 mm and the central axis of the sleeve is 2.75 mm above the planar bottom surface of the body of the horizontal slide 112.

Windage adjustment screw 118 moves the horizontal slide cylindrical sleeve 132 left and right laterally through an adjustment range constrained by a rearward-facing slot 136 defined in vertical tilt member 110. Vertical tilt member slot 136 is 2 mm tall and 13.5 mm wide and opens on the right side of the body of vertical tilt member 110 to be in communication with a transverse bore opening to the right side of the tilt member body and slidably receive horizontal slide sleeve 132 within bore 138, along with windage bias spring 140, as best seen in FIGS. 3 and 6*a*-6*c*.

Windage adjustment screw 118 is kept in place by a threaded member or nut 124 which is received in a circular receiving socket or aperture on the side of the vertical tilt member; the depth of the socket is approximately 1.5 mm, substantially equal to the thickness of the nut so that the nut is sunken within the left side wall to provide a flush fit. The windage adjustment screw is threadably received in the retaining nut 124 which, being round, spins freely within the socket defined in the side of the vertical tilt member. Nut 124 is preferably crimped or bonded to permanently hold windage adjustment screw 118. As noted above, rotation of windage adjustment screw 218 causes horizontal slide cylindrical sleeve 132 to move left and right freely within the vertical tilt member tunnel or bore 138. Vertical tilt member slot 236 provides adequate clearance for the supporting steel segment 234 connecting the horizontal slide sleeve 234 to the exposed rear portion of the horizontal slide 212.

In use, the adjustable sight assembly 100 is installed by inserting the dovetail-shaped base 114 into the transverse dovetailed slot 32 in pistol slide 30, and the gunsmith or shooter estimates an appropriate central location for sight assembly 100, preferably centered over the pistol's bore axis or centerline 34. Base screw(s) 128 are then tightened, preferably with an Allen wrench or hex key, to (at least preliminarily) fix the lateral position of the sight assembly 100 in the slide notch 32. Once installed, the user may twist elevation adjustment screw 116 against its detent to adjust the vertical translation of vertical tilt member 110 which swings through an arc about hinge pin 126. The elevation adjustment of the sight is held steady by bias spring(s) 128, which may provide some shock-absorbent qualities in the event the pistol is dropped.

The user may then turns windage adjustment screw 118 against its spring-biased detent to laterally translate the horizontal slide member 112 to adjust the point of aim of the pistol.

All of the components of sight assembly 100 are preferably fabricated from tool steel or materials customarily employed in gunmaking, and are preferably machined using spark erosion methods or wire electro-discharge machining (wire EDM) methods. In the preferred embodiment of sight assembly 100, as shown in FIGS. 1-11, hinge pin 126 is received within coaxially aligned transverse hinge pin receiving bores, where the base's first sidewall bore and second sidewall bore are necessarily coaxially aligned and the tilt member's pin-receiving bore axis, when aligned with said base's sidewall bores, are all within three to five millimeters (3-5 mm) of the base's front edge.

Referring now to FIGS. 12-23*f*, in a second embodiment of the adjustable rear pistol sight of the present invention, adjustable sight assembly 200 preferably includes a base 214 with a downwardly-projecting dovetail-shaped member adapted to fit in the pistol's transverse dovetail slot, and base 214 carries a vertical tilt member 210 hinged to rotate about an axis defined by an elevation-tilt hinge pin 226 carried by laterally spaced bosses base 214. The vertical translation of the sighting notch 230 (or other optical alignment structure) is accomplished by adjusting an elevation adjustment screw removably received in a threaded bore defined in vertical tilt member 210 and threadably received the base 214. Here again, the elevation adjustment screw 216 has a scalloped head adapted to receive a spring-biased detent pin or rod 220 to provide positive click adjustment to give the user feedback, and to maintain the zero setting during rugged use of the firearm. Vertical tilt member 210 is biased upwardly, away from base 214 by an elevation tilt bias spring 228 or other elastic force-supplying structure (referred to broadly as a "spring").

In the adjustable sight assembly of the second embodiment 200, the vertical tilt member 210 carries a horizontal slide 212 which preferably includes or defines sighting notch 230; vertical tilt member 230 is translatable in the horizontal, or windage, direction by use of a click-detent windage adjustment screw 218. Windage adjustment screw 218 has a scalloped head which is adapted to receive a spring-biased detente pin or rod 222 to provide positive click adjustment and give the user feedback, and to maintain the zero setting during rugged use of the firearm.

As best seen in FIGS. 14, 16 and 19*a* through 19*d*, horizontal slide 212 has a cantilevered, or forwardly-projecting, cylindrical sleeve 232 carried by a 5 mm wide 2 mm thick connecting sleeve support segment 234 affixed to a vertical front wall surface, and the interior of the cylindrical segment is threaded to receive and cooperate with the threaded windage adjustment screw 218. Horizontal slide cylindrical sleeve 232 preferably defines a through-bore with a radius of 2.5 mm threaded with M3×0.35 threads; the outer cylindrical wall preferably has a radius of 2.5 mm and the central axis of the sleeve is 2.75 mm above the planar bottom surface of the body of the horizontal slide 212.

Windage adjustment screw 218 moves the horizontal slide cylindrical sleeve 234 left and right laterally through an adjustment range constrained by a rearward-facing slot 236 defined in vertical tilt member 210. Vertical tilt member slot 236 is 2 mm tall and 13.5 mm wide and opens on the right side of the body of vertical tilt member 210 to be in communication with a transverse bore opening to the right side of the tilt member body and slidably receive horizontal slide sleeve 234 as best seen in FIGS. 16 and 18*a*-18*d*.

Windage adjustment screw 218 is kept in place by a threaded member or nut 224 which is received in a circular receiving socket or aperture on the side of the vertical tilt member; the depth of the socket is approximately 1.5 mm, substantially equal to the thickness of the nut so that the nut is sunken within the left side wall to provide a flush fit. The windage adjustment screw has first and second outer diameters (i.e., 3 mm and 2.5 mm), with the distal end of windage adjustment screw (opposite the head) having the smaller diameter than the majority of the length of the elevation adjustment screw body. The smaller distal portion of the elevation adjustment screw is threadably received in the retaining nut 224 which, being round, spins freely within the socket defined in the side of the vertical tilt member. As noted above, rotation of windage adjustment screw 218 causes horizontal slide cylindrical sleeve 232 to move left and right freely within the vertical tilt member tunnel or bore 238. Vertical tilt member slot 236 provides adequate clearance for the supporting steel segment 234 connecting the horizontal slide sleeve 232 to the exposed rear portion of the horizontal slide 212.

In use, the second embodiment of the adjustable sight assembly 200 is installed by inserting the dovetail-shaped base into the transverse dovetailed slot 32 in a pistol slide 30, and the gunsmith or shooter estimates an appropriate central location for the sight assembly. Base screw 228 is then tightened, preferably with an Allen wrench or hex key, to (at least preliminarily) fix the lateral position of the sight assembly in the slide notch. Once installed, the user may twist elevation adjustment screw 216 against its biased detent rod or pin 220 to adjust the vertical translation of vertical tilt member 210 which swings through an arc about hinge pin 226. The elevation adjustment of the sight is held steady by bias spring 228, which may provide some shock-absorbent qualities in the event the pistol is dropped.

The user then turns windage adjustment screw 218 against its spring-biased detent pin or rod 222 to laterally translate the horizontal slide to adjust the point of aim of the pistol.

All of the components of sight assembly 200 are preferably fabricated from tool steel or materials customarily employed in gunmaking, and are preferably machined using spark erosion methods or wire electro-discharge machining (wire EDM) methods. In the preferred embodiment of sight assembly 200, as shown in FIGS. 12-21*d*, hinge pin 226 is received within coaxially aligned transverse hinge pin receiving bores, where the base's first sidewall bore and second sidewall bore are necessarily coaxially aligned and the tilt member's pin-receiving bore axis, when aligned with said base's sidewall bores, are all within three to five millimeters (3-5 mm) of the base's front edge.

For either embodiment illustrated above, the adjustable sight assembly is adapted for mounting on pistols or other firearms configured to receive a dovetail projection, and provides a compact, rugged, snag free, adjustable structure including a base (e.g., 214) having a front surface, where at least a lower portion of the front surface defines a substantially planar surface segment terminating in a substantially linear front edge. The base also has a substantially planar bottom surface terminating at the front edge to define a selected base front edge angle (e.g., an angle of between 60-70 degrees). The base has a first side wall projecting upwardly from the planar bottom surface and opposing a second side wall projecting upwardly from the planar bottom surface and has a substantially planar base top surface opposite the base bottom surface and the first and second side walls project upwardly from the top surface to define substantially parallel opposing side wall surfaces. The first side wall has a first bore axially aligned with and parallel to the base front edge. The second side wall has a second bore axially aligned with the base front edge and coaxially aligned with the first side wall's bore.

In order to provide a very compact and snag free overall structure, the first bore axis and the second bore axis defining the hinge for the vertical tilt member (e.g., 210) should be very close to (e.g., within five millimeters) of the base front edge. The hinged vertical tilt member has a front edge opposite a rear edge and includes a transverse hinge bore proximate the tilt member front edge; the tilt member carries a sighting notch at the tilt member rear edge. The hinged vertical tilt member is rotatably affixed between the first base side wall and the second base side wall with the transverse hinge bore coaxially aligned with the first sidewall bore and the second sidewall bore so that a hinge pin (e.g., 226) can provide a tilting motion, thereby allowing the sighting notch to move through an arc having a selected vertical sight adjustment range.

The tilt member sighting notch (e.g., 130) is preferably substantially rectangular in shape, having substantially vertical side wall segments separated by a selected notch width (e.g., approximately three millimeters). The tilt member sighting notch is defined in a substantially planar vertical surface proximate said tilt member rear edge, and the entire planar vertical surface is substantially textured or finished with a dull or matte finish, to provide a non-reflective visual reference for framing the pistol's front sight post in the rear notch.

Tilt member (e.g. 110) carries at least one biasing spring member configured to push the vertical tilt member away from the base top surface and through the arc. The tilt member also carries at least one tilt adjustment member (such as elevation adjustment screw 116) configured to limit the vertical position of the vertical tilt member when biased to move through the arc. The tilt adjustment member preferably comprises a threaded fastener having a distally projecting shaft configured to engage a threaded bore in the base and terminating proximally in a flanged head, wherein the flanged head is configured to engage a click detent mechanism. The tilt member preferably carries a horizontally translatable slide member including a non-reflective surface defining the sighting notch.

It will be appreciated by those skilled in the art, that the present invention makes available an optical alignment instrument or sight providing reliable and stable position adjustability in two (preferably orthogonal) directions, and other combinations of these mechanisms can be envisioned which will provide the intended result, namely providing a compact, adjustable optical alignment device to a mount to permit a smooth and snag-free draw, a clear sight picture and rugged service.

Having described preferred embodiments of a new and improved method, it is believed that other modifications, variations and changes will be suggested to those skilled in the art in view of the teachings set forth herein. It is therefore to be understood that all such variations, modifications and changes are believed to fall within the scope of the present invention, as set forth in the following claims.

What is claimed is:

1. An adjustable sight adapted for mounting on a pistol having a transverse dovetail slot, said adjustable sight assembly comprising:

a base, said base having a base front surface, with at least a lower portion of said base front surface defining a substantially planar base lower front surface terminating in a substantially linear base front edge, said base being adapted to be received in said transverse dovetail slot;

a substantially planar base bottom surface, said planar base bottom surface terminating at said linear front edge and cooperating with said planar base lower front surface to define a selected base front edge angle less than 90° and complementary to said transverse dovetail slot;

a first base side wall projecting upwardly from said planar base bottom surface and a second base side wall projecting upwardly from said planar base bottom surface and spaced from said first base side wall in the direction of the transverse dovetail;

a substantially planar base top surface opposite said planar base bottom surface, said first and second spaced base side walls projecting upwardly from said base top surface to define substantially parallel opposing first and second spaced base side wall surfaces;

a base side wall upper beveled surface of each said first and second spaced base side walls;

a first bore in said first base side wall, said first bore having a first bore axis aligned with said base front edge;

a second bore in said second base side wall, said second bore having a second bore axis aligned with said base front edge and being coaxially aligned with said first bore, said first bore axis and said second bore axis being spaced within five millimeters of said base front edge;

a vertical tilt member having a vertical tile member front edge and a vertical tilt member rear edge and including a vertical tilt member hinge bore proximate said vertical tilt member front edge; said vertical tile member carrying a sighting notch, said sighting notch being positioned proximate said tilt member rear edge;

vertical tilt member beveled upper surfaces, said vertical tilt member beveled upper surfaces including a forward portion aligned with said base side wall upper beveled surfaces;

an elevation tilt hinge pin securing said vertical tilt member between said first base side wall and said second base side wall, said vertical tilt member hinge bore being aligned with said first base side wall bore and said second base side wall bore, said elevation tilt hinge pin passing through said vertical tilt member hinge bore and said first and second base side wall bores to provide a tilting motion of said vertical tilt member about said base to allow said sighting notch to move through an arc having a selected vertical range; and a horizontally translatable slide member at said rear edge of said vertical tilt member, said horizontally translatable slide member including said sighting notch and having slide member beveled upper side surfaces, said vertical tilt member beveled upper surfaces including rearward portions aligned with said slide member beveled upper side surfaces, said aligned base side wall upper beveled surfaces, said vertical tilt member beveled upper forward portion, said vertical tilt member beveled upper surface rearward portions, and said slide member beveled upper side surfaces cooperating to define a smooth, snag-resistant upper overall surface of said adjustable sight assembly having an overall length of not greater than 30 mm.

2. The adjustable sight assembly of claim 1, wherein said selected base front edge angle is an angle within the range of 60 degrees to 70 degrees.

3. The adjustable sight assembly of claim 2, wherein said selected base front edge angle is approximately 60 degrees.

4. The adjustable sight assembly of claim 2, wherein said selected base front edge angle is approximately 70 degrees.

5. The adjustable sight assembly of claim 1, wherein each said first bore axis and said second bore axis lie within three millimeters of said base front edge.

6. The adjustable sight assembly of claim 1, wherein said vertical tilt member sighting notch is substantially rectangular and has substantially vertical side wall segments, which vertical wall segments are separated by a selected sighting notch width.

7. The adjustable sight assembly of claim 6, wherein said selected sighting notch width is approximately three millimeters.

8. The adjustable sight assembly of claim 1, wherein said vertical tilt member includes a substantially planar vertical surface proximate said vertical tilt member rear edge and wherein said sighting notch is defined in said substantially planar vertical surface of said vertical tilt member rear edge.

9. The adjustable sight assembly of claim 8, wherein said vertical tilt member planar vertical surface proximate said tilt member rear edge is substantially non-reflective.

10. The adjustable sight assembly of claim 1, wherein said vertical tilt member carries at least one biasing spring member adapted to push said vertical tilt member away from said base top surface and through said arc.

11. The adjustable sight assembly of claim 10, wherein said vertical tilt member carries at least one vertical tilt adjustment member configured to limit a travel distance of said vertical tilt member away from said base top surface when said vertical tilt member is biased to move through said arc.

12. The adjustable sight assembly of claim 11, wherein said vertical tilt adjustment member comprises a threaded fastener having a distally projecting shaft configured to engage a threaded bore in said base and terminating proximally in a flanged head, and further including a click detention mechanism, said flanged head being configured to engage said click detent mechanism.

13. The adjustable sight assembly of claim 12, wherein said flanged head of said vertical tilt adjustment member threaded fastener includes an array of scalloped notches carried around a periphery of said flanged head of said vertical tilt adjustment member threaded fastener and further including a deflecting post click detent mechanism engageable with said array of scalloped notches.

14. The adjustable sight assembly of claim 12, wherein said flanged head of said vertical tilt adjustment member threaded fastener includes an array of radial grooves defined in an underside of said flanged head of said vertical tilt adjustment member threaded fastener, and adapted to engage said click detent mechanism.

15. The adjustable sight assembly of claim 1, wherein said horizontally translatable slide member surface including said sighting notch comprises a substantially planar vertical surface proximate said horizontally translatable slide member rear edge.

16. The adjustable sight assembly of claim 15, wherein said substantially planar vertical surface is substantially non-reflective.

* * * * *